US009826788B2

(12) United States Patent
Martin, II

(10) Patent No.: US 9,826,788 B2
(45) Date of Patent: Nov. 28, 2017

(54) SHOOTING GLOVE

(71) Applicant: Richard Martin, II, Galloway, NJ (US)

(72) Inventor: Richard Martin, II, Galloway, NJ (US)

( * ) Notice: Subject to any disclaimer, the term of this patent is extended or adjusted under 35 U.S.C. 154(b) by 0 days.

(21) Appl. No.: 15/045,367

(22) Filed: Feb. 17, 2016

(65) Prior Publication Data

US 2017/0231301 A1 Aug. 17, 2017

(51) Int. Cl.
*A41D 19/00* (2006.01)
*A41D 19/015* (2006.01)

(52) U.S. Cl.
CPC ... *A41D 19/0013* (2013.01); *A41D 19/01505* (2013.01); *A41D 19/01529* (2013.01); *A41D 2600/20* (2013.01)

(58) Field of Classification Search
CPC ..... A41D 19/0013; A41D 19/01505; A41D 19/01529
See application file for complete search history.

(56) References Cited

U.S. PATENT DOCUMENTS 1,329,996 A * 2/1920 Pacifico ..... A41D 19/0017 2/159
1,358,824 A * 11/1920 Burden ..... A41D 19/015 2/161.8
2,118,463 A * 5/1938 Eden ..... A41D 19/0017 2/163
2,379,430 A * 7/1945 Frost ..... A63B 71/146 2/159
2,380,633 A * 7/1945 Daiber ..... A41D 19/01 2/158
2,554,991 A * 5/1951 Kramer ..... A63B 71/146 2/159
2,782,422 A * 2/1957 Bencriscutto ..... A63B 71/146 2/161.2
3,128,472 A * 4/1964 Kinney ..... A41D 19/0017 15/227
3,608,093 A * 9/1971 Kirby ..... A41D 19/0017 2/163
3,703,007 A * 11/1972 Stewart ..... A41D 19/0013 2/163
3,930,271 A * 1/1976 Kahng ..... A63B 71/146 2/161.4
4,704,743 A * 11/1987 Thornell ..... A41D 19/0013 2/161.1
4,712,253 A * 12/1987 Chen ..... A41D 19/0017 2/161.8
4,785,477 A * 11/1988 Marzo ..... A41D 19/00 2/159
5,592,695 A * 1/1997 Roche ..... A63B 71/146 2/160
5,621,918 A * 4/1997 Bernhard ..... A63B 71/146 2/161.2

(Continued)

*Primary Examiner* — Richale Quinn
(74) *Attorney, Agent, or Firm* — Dunlap Bennett & Ludwig PLLC; Brensan E. Squire

(57) ABSTRACT

A glove that does not have to be removed and allows quick bare index finger trigger contact for shooting of a pistol or rifle. Simple modification of a standard five fingered glove that still allows for normal use after the modification. My invention allows for instant bare finger contact with a control surface, such as a trigger, touch screen display and casting of a fishing line from a spinning reel.

14 Claims, 3 Drawing Sheets

(56) References Cited

U.S. PATENT DOCUMENTS

| | | | | |
|---|---|---|---|---|
| 6,338,163 | B1 * | 1/2002 | Markson | A41D 19/0017 2/161.6 |
| 6,725,465 | B2 * | 4/2004 | Taylor | A63B 71/146 2/161.1 |
| 7,363,660 | B1 * | 4/2008 | Gilliland | A41D 19/0017 2/159 |
| 8,205,269 | B2 * | 6/2012 | Anderson | A63B 71/146 2/161.2 |
| 8,376,872 | B1 * | 2/2013 | Murphy | A63B 71/146 2/161.2 |
| 2008/0010718 | A1 * | 1/2008 | Richards | A41D 19/0013 2/159 |
| 2014/0359915 | A1 * | 12/2014 | Oh | A41D 19/0006 2/163 |
| 2015/0289575 | A1 * | 10/2015 | Krautner | A41D 19/0024 2/160 |

* cited by examiner

SHOOTING GLOVE

BACKGROUND OF THE INVENTION

The present invention relates to gloves and, more particularly, to gloves for use with a control surface, such as the trigger of a firearm.

If a police officer has gloves on his hands one of the gloves must be removed to enable him to shoot his pistol. If he attempts to force his gloved trigger finger into the trigger guard, he risks firing the pistol prematurely. Even if the officer is able to get a gloved trigger finger into the trigger guard, sensitivity and control is greatly diminished. In an emergent situation, too much time may be needed to remove the glove. So for the sake of safety, gloves are often not worn. Bare hands and fingers exposed to cold temperatures for extended periods leads to diminished dexterity, sensitivity and ultimately total loss of function along with the risk of significant injury due to frostbite.

As can be seen, there is a need for an improved glove that can allow a user to keep their hands and trigger finger protected, while allowing the user to quickly respond to an emergent situation requiring the use of a firearm.

SUMMARY OF THE INVENTION

In one aspect of the present invention, an article of hand wear, comprises: a glove body having a plurality of finger sleeves; an index finger sleeve portion attached to the glove body; and an index finger tip portion attached to the adjacent middle finger sleeve. The index finger tip portion is permanently attached to the adjacent middle finger sleeve portion. The glove body will include four finger sleeves and a thumb. The glove body is formed of a thermally protective material, an abrasion protective material, a cut resistant material, or a chemical resistant material.

Other aspects of the invention include a method of providing fingertip control in a gloved work environment, including providing a glove having a plurality of finger sleeves, an index finger sleeve portion attached to the glove body, and an index finger tip portion attached to the adjacent middle finger sleeve; and directing a user to wear the glove. The method may also include directing the user to make a fist or simply grasp the grip of a gun to be able to retract the index finger tip from the index finger tip portion to expose the user's index finger tip. The method may also include directing the user to manipulate a control.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a warming or protective glove that allows a user to quickly and safely use a firearm without the need to remove their gloves.

Figure 1:
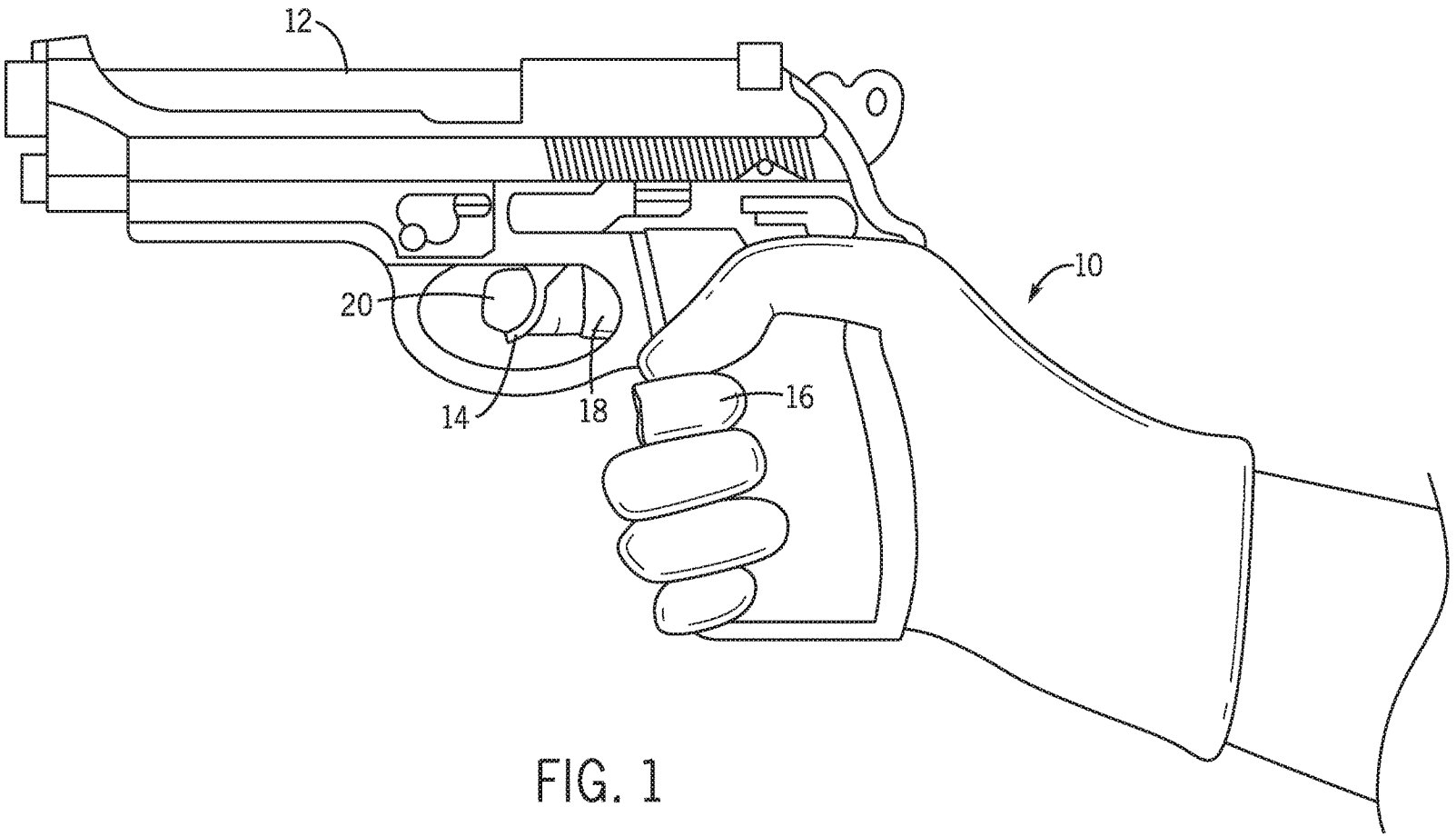
FIG. 1 is a front elevation view of the shooting glove in use.

As best seen in reference to FIG. 1, a shooting glove 10 according to aspects of the present invention is depicted as worn on the hand of a shooter. With the shooting glove 10, the user may hold a firearm 12, such as a pistol, with a gloved hand. The user may retract the tip of their index finger 20 from a separate tip 16 of the glove's index finger 18, and insert their index finger tip 20 into the trigger guard of the firearm 12 and maintain a natural feel on the weapon's trigger 14.

Figure 2:
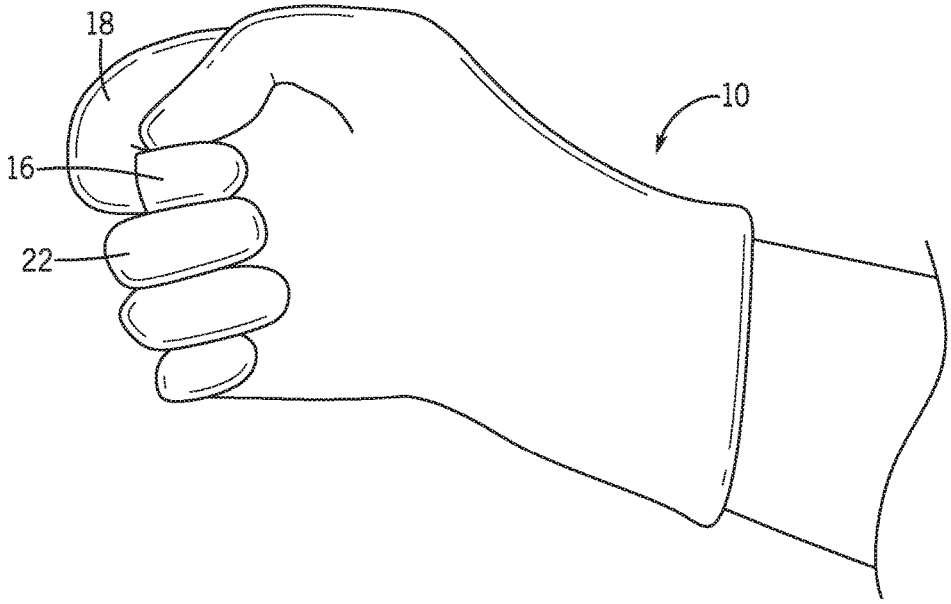
FIG. 2 is front elevation view of the shooting glove in a first mode.

As seen in reference to FIG. 2, a user's hand is shown inserted into the shooting glove 10 without holding a weapon. The glove 10 is formed with an index finger sleeve 18 covering a majority of the user's index finger. In FIG. 2, the user's index finger is depicted inserted into the index finger glove tip 16.

Figure 3:
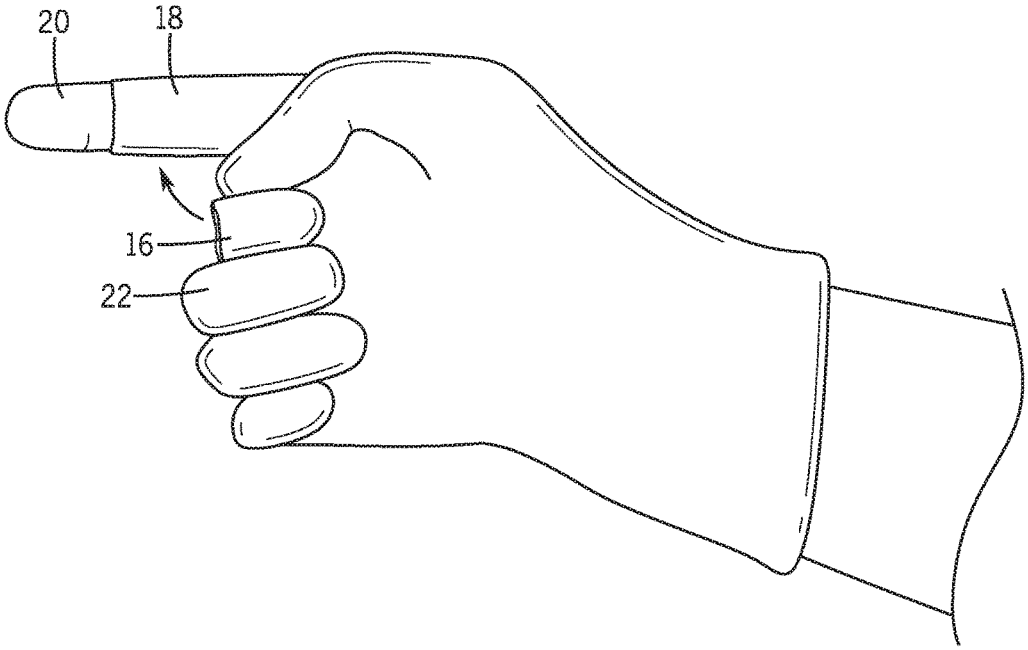
FIG. 3 is a front elevation view of the shooting glove in a second mode.

As seen in reference to FIG. 3, the index finger glove tip 16 is separable from the index finger sleeve 18 and is attached to the adjacent middle finger glove sleeve 22. The index finger glove tip 16 may be permanently attached via a stitch, adhesive, or similar fastener. Alternatively, the glove index finger tip 16 may be removably attached to the adjacent glove sleeve 22 via a fastener such as a snap, a button, or a hook and loop fastener. As illustrated the user need only retract the tip 20 of their index finger from the index finger glove tip 16 in order to expose their index finger tip 20 for shooting, or any other activity that may require fingertip touch sensitivity, such as activation of a smartphone or tablet display, turning pages in a book, casting a fishing line and the like.

Figure 4:
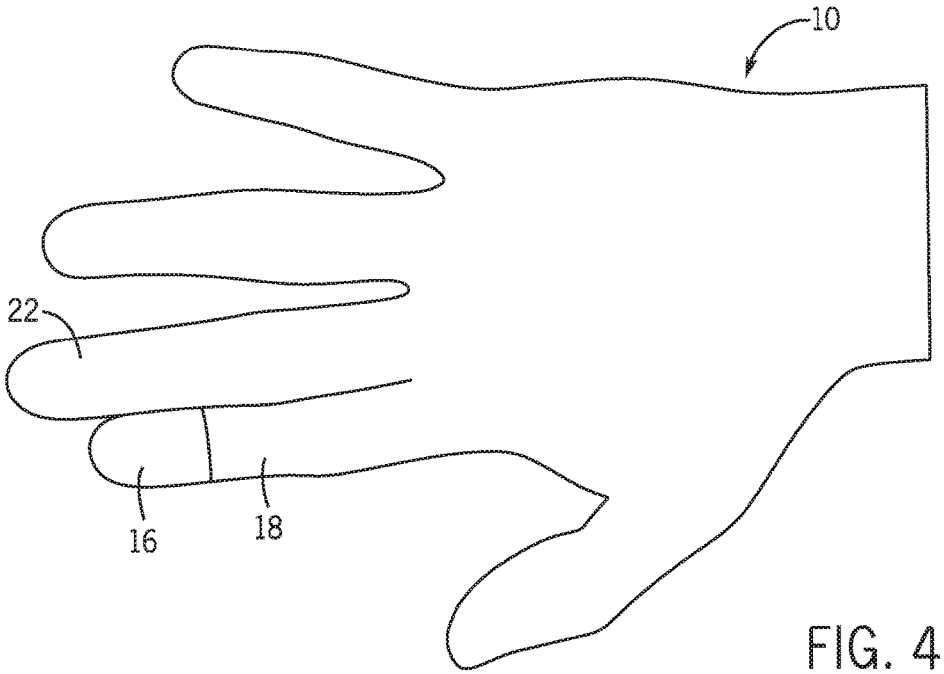
FIG. 4 is a plan view of the invention.

As seen in reference to FIG. 4 the shooting glove 10 of the present invention is shown in a plain view orientation illustrating the index finger sleeve portion 18 and separable index finger tip portion 16 attached to the adjacent glove middle finger sleeve 20.

Figure 5:
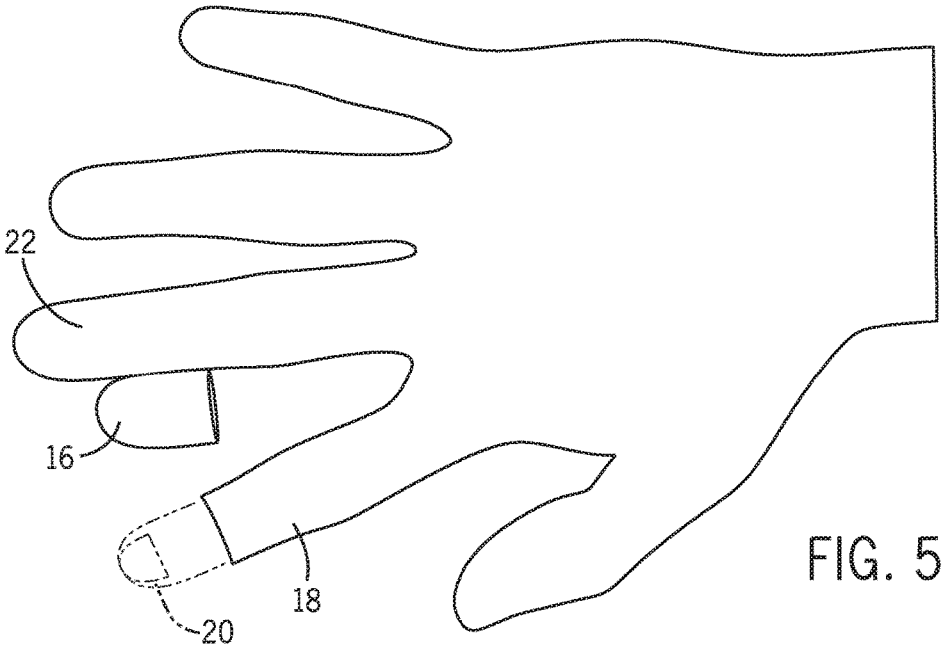
FIG. 5 is another plan view of the invention in a second orientation.

As seen in reference to FIG. 5 the user's fingertip 20 is shown removed from the index finger glove tip 16 and its attachment to the adjacent middle finger glove sleeve 20.

As will be appreciated, the shooting glove 10 of the present invention may be formed as a left hand glove, or a right hand glove, depending upon the shooter's needs. The shooting gloves 10, may also be formed as a matched pair.

While intended for use with respect to cold weather, the glove 10 may be formed of any suitable protective material that may be needed for law enforcement, military, and sportsmen. The invention disclosed and claimed herein, is adaptable to any field where glove work is required and fingertip control of equipment is necessary, such dialing phones, pushing buttons, turning pages of paper, and the like. For cold weather conditions, the glove and glove fingertip 16 may be formed of a thermally protective material, with or without an insulated liner. It may also be formed of other protective materials, such as for toxic material handling environments, abrasion or cut resistance, and the like.

It should be understood, of course, that the foregoing relates to exemplary embodiments of the invention and that modifications may be made without departing from the spirit and scope of the invention as set forth in the following claims.

What is claimed is:

1. An article of hand wear, comprising:

a glove body having a plurality of finger sleeves configured to cover a plurality of fingers of a wearer;

an index finger sleeve portion attached to the glove body, the index finger sleeve portion having an opening at a distal end thereof, the index finger sleeve portion configured to partially cover an index finger of a wearer from a proximal end of the index finger;

an adjacent finger sleeve having a proximal end opening to an interior of the glove body, a distal end opposite the proximal end, and a first lateral side surface facing towards the index finger sleeve portion; and an index finger tip portion attached along the first lateral side surface at an intermediate position between the distal end and the proximal end of the adjacent finger sleeve, the index finger tip portion having a closed distal end and an open proximal end entirely separated around a circumference of the open proximal end from the index finger sleeve portion and configured for selectively accepting the remainder of the index finger when the hand wear is worn.

2. The article of claim 1, wherein the index finger tip portion is permanently attached to the adjacent finger sleeve portion.

3. The article of claim 1, wherein the glove body comprises three finger sleeves.

4. The article of claim 3, wherein the glove body further comprises a thumb sleeve.

5. The article of claim 1, wherein the glove body is formed of a thermally protective material.

6. The article of claim 1, wherein the glove body is formed of an abrasion protective material.

7. The article of claim 1, wherein the glove body is formed of a cut resistant material.

8. The article of claim 1, wherein the glove body is formed of a chemical resistant material.

9. An article of hand wear, comprising:

a glove body configured to receive a hand and fingers of a wearer;

an index finger sleeve portion extending from the glove body and having a distal end opening such that the index finger sleeve portion is configured to partially cover a proximal portion of an index finger of the wearer when received therein;

an adjacent finger sleeve extending from the glove body having a closed distal end to cover one or more of the fingers of the wearer, a proximal end opening to an interior of the glove body and a first lateral side surface oriented towards the index finger sleeve portion; and an index finger tip portion disconnected from the index finger sleeve portion and attached to the first lateral side surface at an intermediate location between the distal end and the proximal end of the adjacent finger sleeve, wherein the index finger tip portion has a distal closure and a proximal index finger opening configured to selectively receive a remainder of the index finger of the same hand upon which the glove body is worn.

10. The article claim 9, wherein the index finger tip portion is permanently attached to a side of the adjacent finger sleeve portion permitting the tip portion of the index finger to be inserted and retracted by the wearer at will without assistance from an opposite hand.

11. The article of claim 9, wherein the glove body comprises four finger sleeves.

12. The article of claim 9, further comprising:

a thumb sleeve extending from the glove body.

13. The article of claim 9, wherein the glove body is formed of a thermally protective material.

14. The article of claim 9, wherein the index finger sleeve portion has a length configured to correspond to a point between a first and a second joint of a user's index finger.

* * * * *